US007504777B2

(12) United States Patent
Kang

(10) Patent No.: US 7,504,777 B2
(45) Date of Patent: Mar. 17, 2009

(54) PLASMA DISPLAY PANEL WITH SEMI-CIRCULAR DISCHARGE ELECTRODE STRUCTURE

(75) Inventor: Tae-Kyoung Kang, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 387 days.

(21) Appl. No.: 11/190,627

(22) Filed: Jul. 27, 2005

(65) Prior Publication Data

US 2006/0028138 A1 Feb. 9, 2006

(30) Foreign Application Priority Data

Aug. 7, 2004 (KR) ..... 10-2004-0062236

(51) Int. Cl.
*H01J 17/49* (2006.01)

(52) U.S. Cl. ..... 313/585; 313/582; 313/586

(58) Field of Classification Search ..... 313/582–587; 315/169.1, 169.3; 345/60, 75.2
See application file for complete search history.

(56) References Cited

U.S. PATENT DOCUMENTS

| | | | | |
|---|---|---|---|---|
| 6,376,986 | B1 | 4/2002 | Takagi et al. | |
| 6,522,072 | B1 * | 2/2003 | Yura et al. | 313/582 |
| 6,670,754 | B1 | 12/2003 | Murai et al. | |
| 6,819,046 | B2 * | 11/2004 | Hirano | 313/582 |
| 6,856,305 | B2 * | 2/2005 | Nagano | 345/60 |
| 6,940,225 | B2 * | 9/2005 | Araki et al. | 313/582 |
| 7,081,706 | B2 * | 7/2006 | Huang et al. | 313/583 |
| 2002/0050792 | A1 | 5/2002 | Shirozu | |
| 2002/0130618 | A1 | 9/2002 | Hasegawa et al. | |
| 2002/0135303 | A1 | 9/2002 | Hashimoto | |
| 2003/0080682 | A1 | 5/2003 | Nagano | |
| 2004/0027068 | A1 * | 2/2004 | Chien et al. | 313/581 |
| 2004/0135509 | A1 * | 7/2004 | Kwon et al. | 313/584 |

(Continued)

FOREIGN PATENT DOCUMENTS

EP 1052670 A 11/2000

(Continued)

*Primary Examiner*—Nimeshkumar D. Patel
*Assistant Examiner*—Anne M Hines
(74) *Attorney, Agent, or Firm*—Knobbe Martens Olson & Bear LLP

(57) ABSTRACT

A plasma display panel (PDP) having a simple manufacturing process, and improved discharge stability, brightness, and light emission efficiency is disclosed. In one embodiment, the PDP includes i) an upper substrate and a lower substrate facing each other, ii) a plurality of barrier ribs disposed between the upper substrate and the lower substrate to define a plurality of discharge cells together with the upper substrate and the lower substrate, iii) at least one pair of discharge electrodes that generate a discharge and extend across the discharge cells consecutively disposed in one direction, iv) a plurality of address electrodes disposed to cross the discharge electrodes across the discharge cells consecutively disposed in another direction v) an upper dielectric layer and a lower dielectric layer respectively covering at least one pair of discharge electrodes and the address electrodes; a fluorescent layer disposed in the discharge cells, and vi) a discharge gas filled in the discharge cells. In one embodiment, each discharge electrode includes a plurality of substantially semi-circular concave portions each of which is formed in a direction generally facing the center area, in a plane which is substantially parallel to the substrates, of a respective discharge cell.

16 Claims, 6 Drawing Sheets

U.S. PATENT DOCUMENTS

| | | | |
|---|---|---|---|
| 2004/0183440 | A1 | 9/2004 | Huang et al. |
| 2005/0029941 | A1 | 2/2005 | Kwon et al. |

FOREIGN PATENT DOCUMENTS

| | | | |
|---|---|---|---|
| EP | 1202319 | A | 5/2002 |
| JP | 02-168533 | | 6/1990 |
| JP | 2002-050298 | | 2/2002 |
| JP | 2002-324488 | | 11/2002 |
| JP | 2003177707 | A | 6/2003 |
| JP | 2005-056826 | | 3/2005 |
| WO | WO 02/17345 | A1 | 2/2002 |

* cited by examiner

PLASMA DISPLAY PANEL WITH SEMI-CIRCULAR DISCHARGE ELECTRODE STRUCTURE

CROSS-REFERENCE TO RELATED PATENT APPLICATION

This application claims the benefit of Korean Patent Application No. 10-2004-0062236, filed on Aug. 7, 2004, in the Korean Intellectual Property Office, the disclosure of which is incorporated herein in its entirety by reference. This application also relates to U.S. patent application Ser. No. 11/158,519 entitled "Plasma Display Panel," filed on Jun. 22, 2005, which is incorporated by reference.

BACKGROUND OF THE INVENTION

1. Field of the Invention

The present invention relates to a plasma display panel, and more particularly, to a plasma display panel having a structure that can be simply manufactured, generates a stable discharge, and has improved brightness and light emission efficiency.

2. Description of the Related Technology

Recently, plasma display panels (PDPs) have received considerable attention as the next generation flat display devices due to their large screen size, large viewing angle, high image quality, ultra thin and light weight design, and simple manufacturing process when compared to other flat display devices.

PDPs can be categorized into direct current type PDPs and alternate current type PDPs according to the discharge type, and into facing discharge type PDPs and surface discharge type PDPs. Mainly, three-electrode surface discharge type PDPs are fabricated.

FIG. 1 is a cutaway exploded perspective view of a conventional three-electrode surface discharge type PDP. The PDP includes an upper panel 10 and a lower panel 20 facing the upper panel 10. Referring to FIG. 1, i) a pair of discharge electrodes 50 disposed on a lower surface of an upper substrate 11, ii) an upper dielectric layer 14 burying the discharge electrodes 50, and iii) a protection layer 15 covering the upper dielectric layer 14 are sequentially formed. One electrode of the discharge electrodes 50 is a common electrode 30 and the other electrode is a scanning electrode 40.

A plurality of address electrodes 22 extended to cross the discharge electrodes 50 and a lower dielectric layer 23 covering the address electrodes 22 are formed on an upper surface of a lower substrate 21. A plurality of discharge cells 60 are defined by barrier ribs 24 formed on the lower dielectric layer 23. A fluorescent layer 25 is formed on the lower dielectric layer 23 which is surrounded by the barrier ribs 24 across both side walls of the barrier ribs 24.

Each of the common electrode 30 and the scanning electrode 40 includes transparent electrodes 30*a* and 40*a* and bus electrodes 30*b* and 40*b*. The transparent electrodes 30*a* and 40*a* are formed of a transparent and conductive material that does not interrupt the progress of light emitted from the fluorescent layer, and typically formed of an indium tin oxide (ITO) film. However, due to its material characteristics, a particular patterning technique, such as sputtering which requires expensive equipment and a complicated process, must be used to form the ITO film.

Also, in order to improve the electric conductivity of the transparent electrodes 30*a* and 40*a*, additional aligning with the bus electrodes 30*b* and 40*b* is required since the bus electrodes 30*b* and 40*b* formed of a conductive metal must be formed on an outer end of the transparent electrodes 30*a* and 40*a*. Furthermore, when the bus electrodes 30*b* and 40*b* are formed on the ITO film, the bus electrodes 30*b* and 40*b* may not be melted or may not tightly contact the ITO film according to the kind of electrode material. The aligning of the ITO film with the bus electrodes 30*b* and 40*b* is also difficult since the ITO film is transparent.

In addition to the manufacturing difficulties, the light transmittance of the transparent electrodes 30*a* and 40*a* is approximately 80%, i.e., light loss is approximately 20%. The low light emission efficiency of the PDP is a disadvantage.

To solve these problems, a PDP in which discharge electrodes include only bus electrodes has been developed. However, in the PDP, a discharge cannot readily diffuse into the entire discharge cells since the bus electrodes having a narrow width are formed in consideration of the light transmittance, thereby reducing brightness and light emission efficiency.

SUMMARY OF CERTAIN INVENTIVE ASPECTS

One embodiment of the present invention provides a plasma display panel (PDP) that can be manufactured in a simple process and has improved work efficiency.

Another embodiment of the present invention provides a PDP that produces a stable discharge in the entire discharge cell region and has improved brightness and light emission efficiency.

Another aspect of the present invention provides a plasma display panel (PDP). In one embodiment, the PDP comprises i) an upper substrate and a lower substrate facing each other, ii) a plurality of barrier ribs disposed between the upper substrate and the lower substrate to define a plurality of discharge cells together with the upper substrate and the lower substrate, iii) at least one pair of discharge electrodes that generate a discharge and extend across the discharge cells consecutively disposed in one direction, iv) a plurality of address electrodes disposed to cross the discharge electrodes across the discharge cells consecutively disposed in another direction, v) an upper dielectric layer and a lower dielectric layer respectively covering the at least one pair of discharge electrodes and the address electrodes, vi) a fluorescent layer disposed in the discharge cells, and vii) a discharge gas filled in the discharge cells. In the at least one pair of discharge electrodes, a plurality of concave parts with a predetermined distance from each other and having a shape surrounding an inner side of each of the discharge cells are formed along the extending direction of the pair of discharge electrodes.

Another aspect of the present invention provides a plasma display panel (PDP). In one embodiment, the PDP comprises i) an upper substrate and a lower substrate facing each other, ii) a plurality of barrier ribs disposed between the upper substrate and the lower substrate to define a plurality of discharge cells together with the upper substrate and the lower substrate, iii) a plurality of discharge electrode pair extended across the discharge cells consecutively disposed in one direction, iv) a plurality of address electrodes disposed to cross the discharge electrodes across the discharge cells consecutively disposed in another direction, v) an upper dielectric layer and a lower dielectric layer, respectively, covering at least one pair of discharge electrodes and the address electrodes, vi) a fluorescent layer disposed in the discharge cells, and vii) a discharge gas filled in the discharge cells. In one embodiment, each of the discharge electrodes that constitute the discharge electrode pair comprises i) first electrode and third electrode extended parallel to each other in one direction and separated from each other and ii) a second electrode in which a plurality of concave parts having a shape surrounding the inner side of the discharge cells along the extending direction and disposed between the first electrode and the third electrode.

In one embodiment, the concave parts may be formed in a semi-circular shape having a predetermined curvature radius.

In one embodiment, in the discharge electrodes, the first electrode may be disposed on the innermost side of the discharge cells and a plurality of first concave parts that have a shape surrounding the center of each of the discharge cells may be formed along the extending direction of the first electrode.

In one embodiment, the plasma display panel may further comprise a plurality of connecting electrodes formed with a predetermined distance from each other in an extending direction of the first electrode, the second electrode, and third electrode, in order to connect the first electrode, the second electrode, and the third electrode to each other.

BRIEF DESCRIPTION OF THE DRAWINGS

Embodiments of the present invention will be described with reference to the attached drawings.

DETAILED DESCRIPTION OF CERTAIN INVENTIVE EMBODIMENTS

A plasma display panel (PDP) according to embodiments of the present invention will now be described more fully with reference to the accompanying drawings in which exemplary embodiments of the invention are shown.

Figure 1:
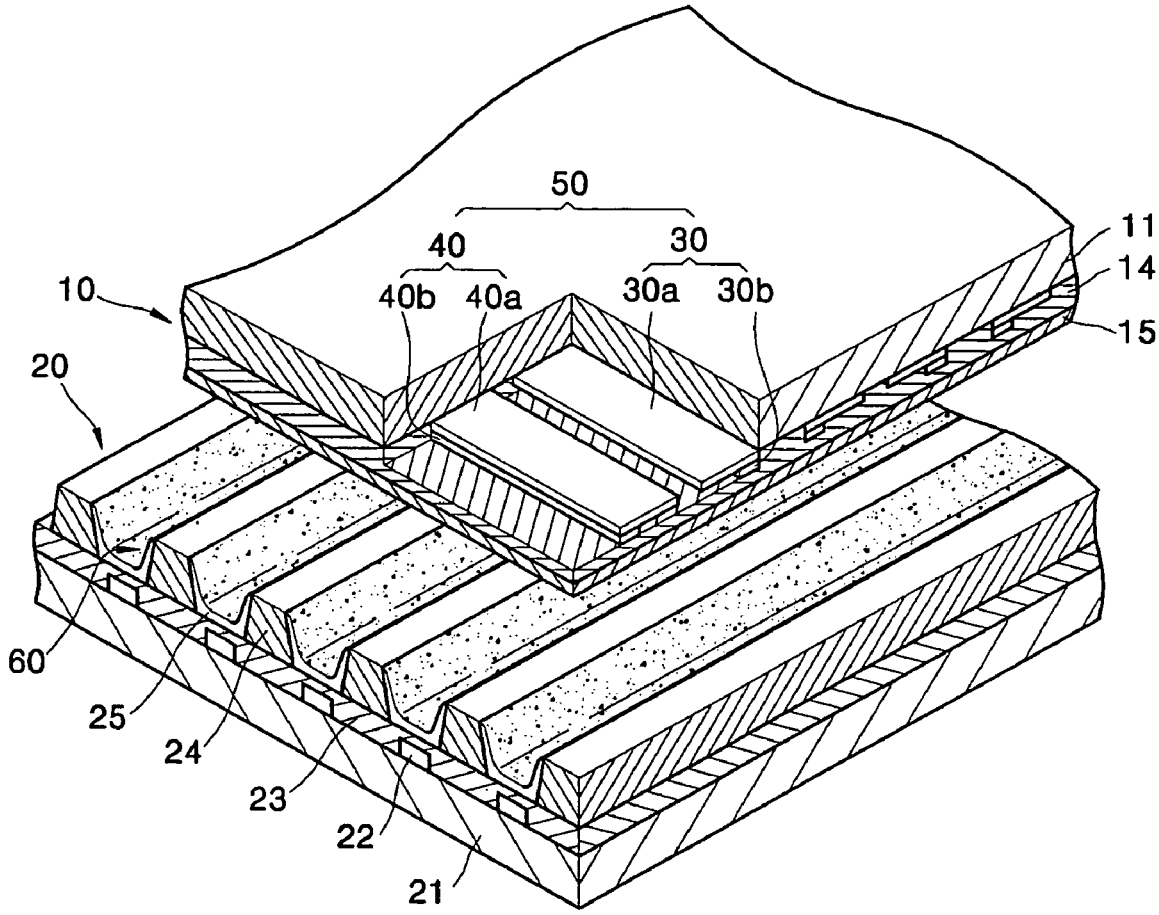
FIG. 1 (PRIOR ART)
FIG. 1 is a cutaway exploded perspective view of a conventional three-electrode surface discharge type PDP.
Figure 2:
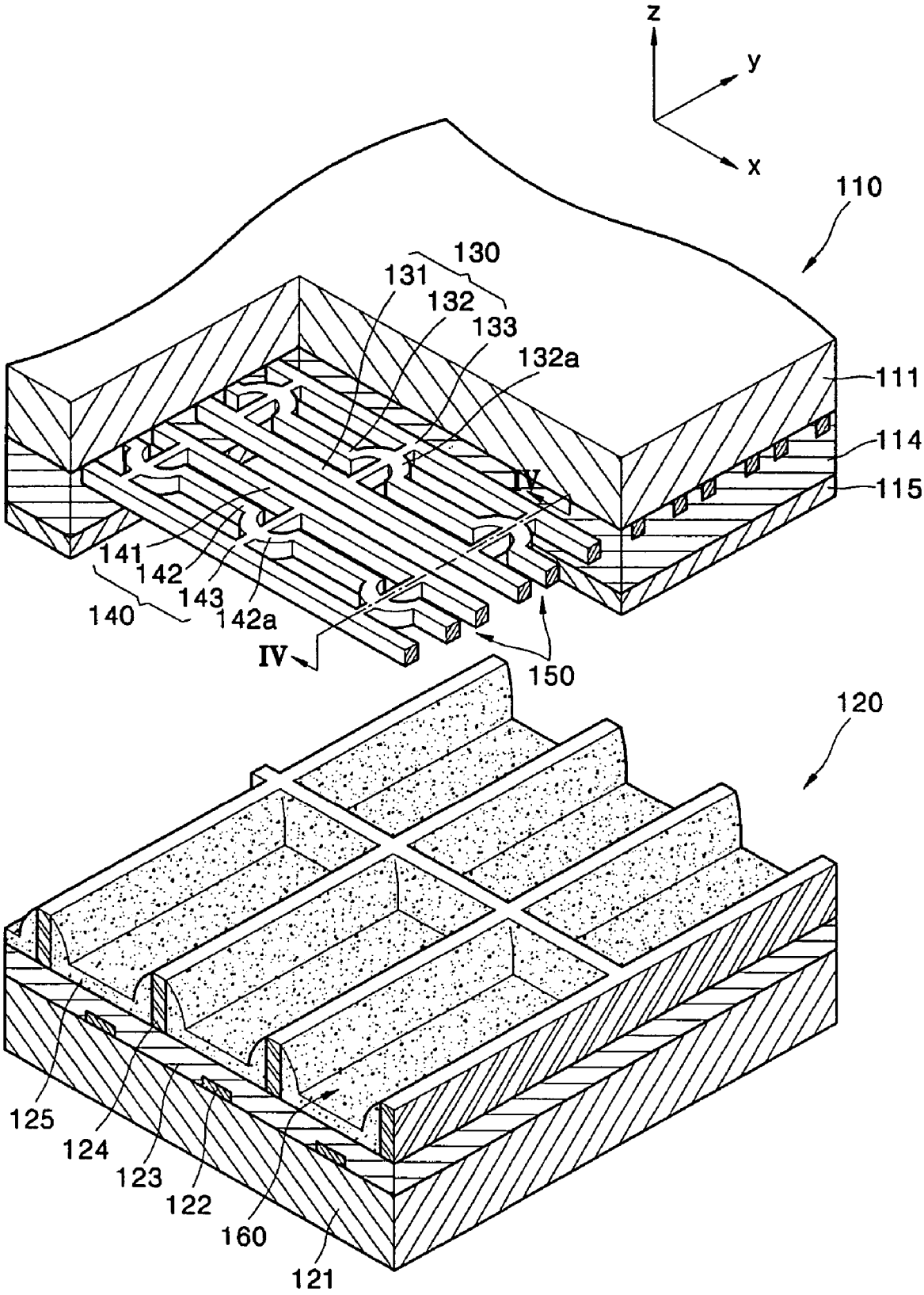
FIG. 2 is a cutaway exploded perspective view of a PDP according to an embodiment of the present invention.
Figure 3:
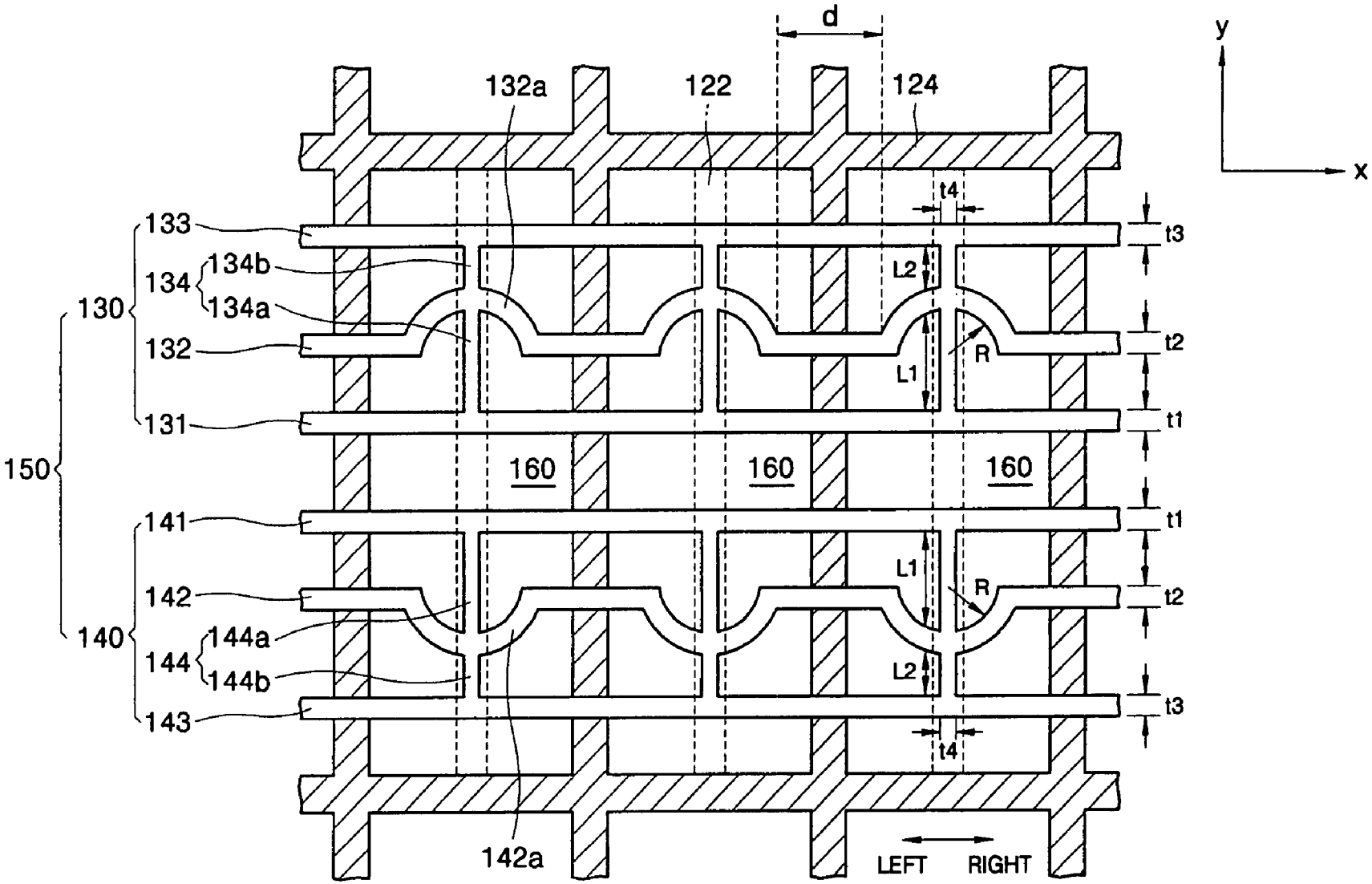
FIG. 3 is a plan view of an electrode structure of the PDP in FIG. 2.

The PDP is depicted in FIGS. 2 and 3. Referring to FIG. 2, the PDP includes an upper panel 110 and a lower panel 120 facing the upper panel 110.

The upper panel 110 includes an upper substrate 111, a plurality of discharge electrode pairs 150 formed in a predetermined pattern below the upper substrate 111, an upper dielectric layer 114 that buries the discharge electrode pairs 150, and a protection layer 115 covering the upper dielectric layer 114.

In one embodiment, the upper substrate 111 is generally formed of a transparent material containing glass as a main component. The discharge electrode pairs 150 separated a predetermined distance from each other and parallel to each other are formed below the upper substrate 111. One discharge electrode pair 150 includes two discharge electrodes 130 and 140 facing each other. One of the discharge electrodes 130 and 140 is a common electrode 130 and the other electrode is a scanning electrode 140. An image is displayed through a sustaining discharge generated between the common electrode 130 and the scanning electrode 140.

Referring to FIG. 3, each of the common electrode 130 and the scanning electrode 140 includes first electrodes 131 and 141, second electrodes 132 and 142, and third electrodes 133 and 143 disposed in a direction from an inner side of a discharge cell 160 toward an edge. Each electrode 130 and 140 also includes a plurality of connecting electrodes 134 and 144 for connecting the electrodes 131-133 and 141-143, respectively.

The first electrodes 131 and 141 are extended in a direction (x direction) across the innermost side of the discharge cell 160. When a predetermined alternating current large enough to generate a discharge is applied to the common electrode 130 and the scanning electrode 140, an initial discharge is generated between the first electrodes 131 and 141. Thereafter, the discharge diffuses into the second electrodes 132 and 142 and the third electrodes 133 and 143.

In one embodiment, the discharge state is different according to the line width (t1) of each of the first electrodes 131 and 141. For example, a stable discharge can be generated as the line width (t1) of the first electrodes 131 and 141 increases. However, brightness is reduced due to low light transmittance and driving efficiency is reduced due to the increase in the discharge current. On the contrary, as the line width (t1) decreases, the brightness increases due to high light transmittance and the driving efficiency increases due to the limited discharge current, but the discharge becomes unstable. In one embodiment, to secure a stable discharge and an aperture ratio, the line width t1 may be about 60 μm-about 80 μm. In one embodiment, the first electrodes 131 and 141 may be formed of a metal having high electric conductivity, such as Ag, Au, Al, Cu, Cr, or a stacking layer thereof.

The third electrodes 133 and 143 are formed on the outermost side of the first electrodes 131 and 141 at a predetermined distance from each other and extended in a direction (x direction) substantially parallel to the first electrodes 131 and 141. In one embodiment, the third electrodes 133 and 143 may also be formed of a metal having high electric conductivity the same as the first electrodes 131 and 141. The third electrodes 133 and 143 can be terminal electrodes to which an external driving voltage can be applied. In this case, the external driving voltage applied to the third electrodes 133 and 143 can also be applied to the first electrodes 131 and 141 and the second electrodes 132 and 142 through the connecting electrodes 134 and 144.

The second electrodes 132 and 142 are disposed between the first electrodes 131 and 141 and the third electrodes 133 and 143. In one embodiment, a plurality of concave parts 132*a* and 142*a* separated a predetermined distance (d) from each other are formed along the extending direction of the second electrodes 132 and 142 in the second electrodes 132 and 142. In one embodiment, the concave parts 132*a* and 142*a* can be formed to have a semi-circular shape with a predetermined curvature radius (R) so as to surround an inner side of each of the discharge cells 160. In one embodiment, the concave parts 132*a* and 142*a* make plasma concentrated in the center area of the discharge cells 160 through electric field strengthening. In this embodiment, an electric field plane generated in a semi-circular shape along the concave parts 132*a* and 142*a* promotes the generation of plasma and prevents the plasma from disappearing by colliding with the barrier ribs 124. Also, the concave parts 132*a* and 142*a* function to promote the discharge diffusion between the second electrodes 132 and 142 and the third electrodes 133 and 143, which will be described later. In one embodiment, the line widths t2 and t3 of the second electrodes 132 and 142 and the third electrodes 133 and 143 may be about 60 μm-about 80 μm so as to secure a sufficient aperture ratio and to stable discharge diffusion.

A plurality of connecting electrodes 134 and 144 separated a predetermined distance from each other are formed along the extending direction of the common electrode 130 and the scanning electrode 140. The connecting electrodes 134 and 144 include first parts 134*a* and 144*a* and second parts 134*b* and 144*b*, respectively. The first parts 134*a* and 144*a* connect the first electrodes 131 and 141 and the second electrodes 132 and 142, respectively. The second parts 134*b* and 144*b* connect the second electrodes 132 and 142 and the third electrodes 133 and 143, respectively. The connecting electrodes 134 and 144 connect the electrodes (131-133 and 141-143) to each other through a curved point of the concave parts 132*a* and 142*a* as shown in FIG. 3. In one embodiment, the length L1 of the first parts 134*a* and 144*a* is different from the length L2 of the second parts 134*b* and 144*b*.

The connecting electrodes 134 and 144 cause an initial discharge, which has begun in the first electrodes 131 and 141, to diffuse into the second electrodes 132 and 142 and the third electrodes 133 and 143 by connecting the electrodes to each other. That is, when a predetermined alternate current is applied to the common electrode 130 and the scanning electrode 140, a discharge is initiated between the first electrodes 131 and 141. The initial discharge diffuses into the second electrodes 132 and 142 along the first parts 134*a* and 144*a* of the connecting electrodes 134 and 144. At this time, the discharge smoothly diffuses into the second electrodes 132 and 142 which are disposed adjacent to the first electrodes 131 and 141. Thereafter, the discharge rapidly diffuses into further wide regions, since active discharges are generated between the first electrodes 131 and 141. Accordingly, even though the length L1 of the first parts 134*a* and 144*a* is relatively greater than the length L2 of the second parts 134*b* and 144*b*, the discharge can stably diffuse into the second electrodes 132 and 142 since the second electrodes 132 and 142 are disposed relatively closer to the discharge center as shown in FIG. 3.

The discharge that has diffused into the second electrodes 132 and 142 diffuses into the third electrodes 133 and 143 along the second parts 134*b* and 144*b* of the connecting electrodes 134 and 144. However, the discharge diffusion into the third electrodes 133 and 143 is relatively difficult compared to the previous diffusion since the third electrodes 133 and 143 are disposed relatively farther from the discharge center. Therefore, in one embodiment of the present invention, the discharge diffusion into the third electrodes 133 and 143 can be smoothly achieved by forming the length L2 of the second parts 134*b* and 144*b*, which respectively connect the second electrodes 132 and 142 to the third electrodes 133 and 143, relatively shorter than the length L1 of the first parts 134*a* and 144*a*. Here, the length of the second parts 134*b* and 144*b* of the connecting electrodes 134 and 144 is the shortest (shortest distance L2) distance between the second electrodes 132 and 142 and the third electrodes 133 and 143. The distance progressively increases along left and right sides of the second parts 134*b* and 144*b*. Accordingly, the discharge diffused along the second parts 134*b* and 144*b* of the connecting electrodes 134 and 144 further diffuses into left and right sides of the second parts 134*b* and 144*b*.

To have a uniform diffusion of a sustain discharge into the entire discharge cells 160 through the connecting electrodes 134 and 144, the connecting electrodes 134 and 144 may be formed across the center of the discharge cells 160. However, when the connecting electrodes 134 and 144 are formed in the center of the discharge cells 160, the transmittance of visible light may be reduced. Therefore, the width (t4) of the connecting electrodes 134 and 144 may be limited. For example, the line width (t4) of the connecting electrodes 134 and 144 can be about 40 μm-about 60 μm. A voltage drop along a length direction (x direction) of the common electrode 130 and the scanning electrode 140 can be prevented by connecting the connecting electrodes 134 and 144. Therefore, a uniform driving voltage can be applied to the common electrode 130 and the scanning electrode 140.

Even though it is not shown in the drawing, when a light absorbing layer having a light absorption rate greater than about 50% is formed above the common electrode 130 and the scanning electrode 140, image quality can be improved even though an additional black stripe for absorbing external light is not formed.

Referring to FIG. 2 again, an upper dielectric layer 114 covering the discharge electrode pair 150 is formed on a lower part of the upper substrate 111. The upper dielectric layer 114 prevents the discharge electrode pair 150 from being damaged by the collision of positive ions or electrons and facilitates the accumulation of wall charges by inducing charges. In one embodiment, the upper dielectric layer 114 can be formed of a dielectric, such as PbO, $B_2O_3$, or $SiO_2$.

The protection layer 115 can be omitted depending on embodiments or situation. The protection layer 115 prevents the upper dielectric layer 114 from being damaged by the collision of positive ions or electrons when a discharge is generated, and facilitates the discharge of a large number of secondary electrons. The protection layer 115 is typically formed of an MgO film.

In one embodiment, the lower panel 120 includes i) a lower substrate 121, ii) a plurality of address electrodes 122 formed in a predetermined pattern on the lower substrate 121, iii) a lower dielectric layer 123 that buries the address electrodes 122, iv) the barrier ribs 124 formed on the lower dielectric layer 123 and defining a plurality of discharge cells 160, and v) a fluorescent layer 125 disposed on an inner sides of the discharge cells 160.

The lower substrate 121 supports the address electrodes 122 and the lower dielectric layer 123, and typically formed of a material containing glass as the main component. The purpose of the address electrodes 122 is to generate an address discharge that facilitates the generation of a sustain discharge between the common electrode 130 and the scanning electrode 140. More specifically, the address electrodes 122 reduce the voltage for generating a sustain discharge. The address electrodes 122 are formed to cross the discharge electrode pair 150 and can be formed in a stripe pattern extending in a y direction.

The lower dielectric layer 123 prevents the address electrodes 122 from being damaged by the collision of positive ions or electrons when a discharge is generated, and can be formed of, for example, PbO, $B_2O_3$, or $SiO_2$.

As depicted in FIG. 2, the barrier ribs 124 can be formed in a matrix pattern extending in the x direction and the y direction. The barrier ribs 124 block optical and electrical cross-talk between the discharge cells 160 by defining a discharge space between the upper substrate 111 and the lower substrate 121 into a plurality of discharge cells 160.

Referring to FIG. 2, the fluorescent layer 125 is formed on the lower dielectric layer 123 surrounded by the barrier ribs 124 crossing side surfaces of the barrier ribs 124. Here, the discharge cell 160 denotes a sub-pixel that constitutes one pixel, and the discharge cells 160 are distinguished into a red light emitting sub-pixel, a green light emitting sub-pixel, and a blue light emitting sub-pixel according to the kinds of the fluorescent layer 125. Phosphor that transforms vacuum ultraviolet rays radiated from plasma into visible light is coated on the fluorescent layer 125. In one embodiment, $Y(V,P)O_4$:Eu can be coated in the red light emitting sub-pixel, $Zn_2SiO_4$:Mn can be coated in the green light emitting sub-pixel, and BAM:Eu can be coated in the blue light emitting sub-pixel. Even though it is not shown in FIG. 2, a discharge gas, such as Ne, Xe, and a mixture of these gases, is filled in the discharge cells 160.

Figure 4:
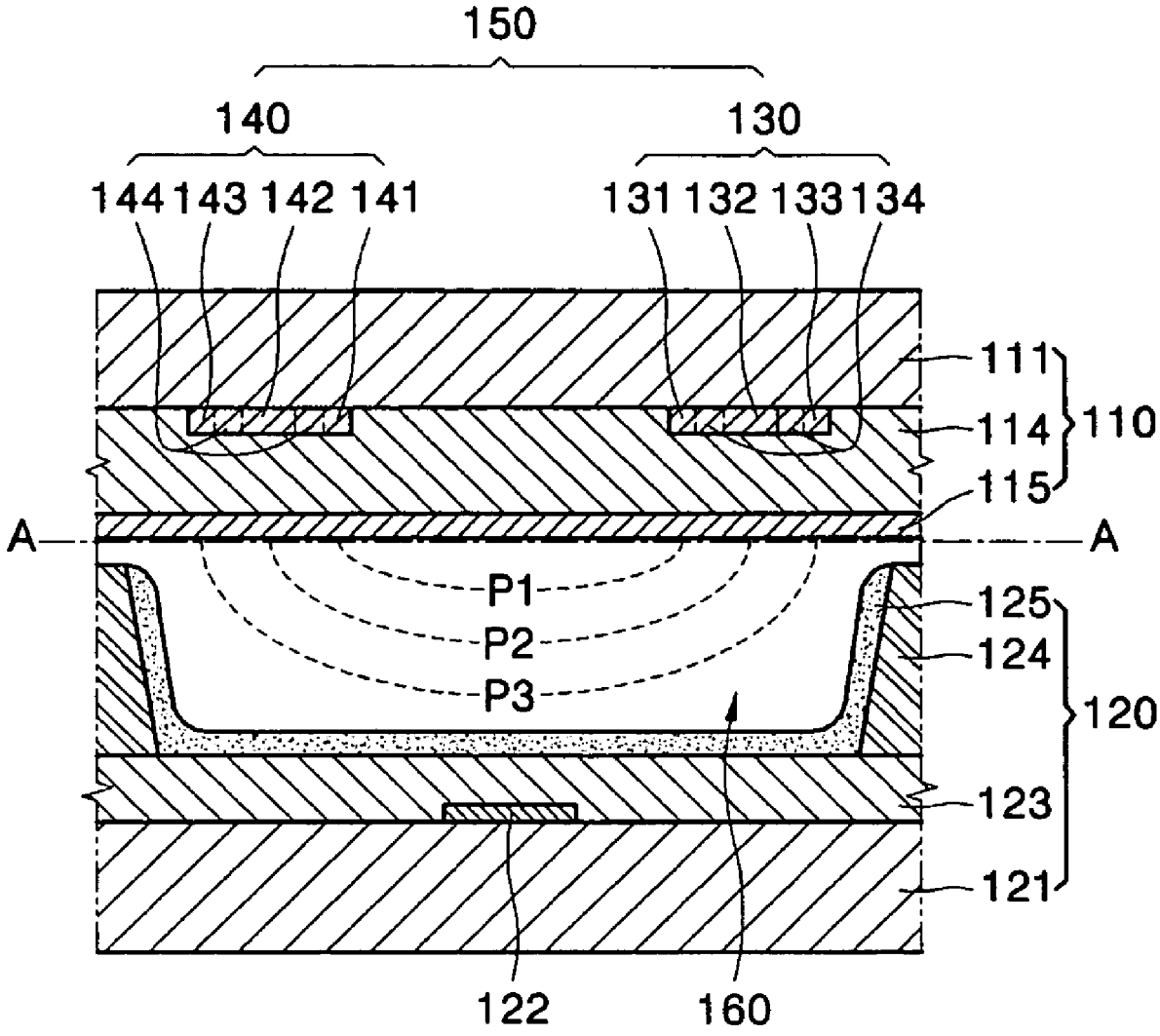
FIG. 4 is a cross-sectional view taken along the line IV-IV of FIG. 2.

FIG. 4 is a cross-sectional view taken along the line IV-IV of FIG. 2. For convenience of explanation, the lower panel 120 depicted in FIG. 4 has been rotated by 90° with respect to line A-A. Referring to FIG. 4, in a PDP having the above structure, an address discharge is generated between the address electrodes 122 and the scanning electrode 140 when an address voltage is applied therebetween, and discharge cells 160 in which sustain discharge will be generated are selected as the result of the address discharge.

Afterward, when a predetermined alternate voltage is applied between the common electrode 130 and the scanning electrode 140 of the selected discharge cell 160, a sustain discharge is generated between the common electrode 130 and the scanning electrode 140. Here, a sustain discharge P1 is initiated between the first electrodes 131 and 141. Thereafter, the sustain discharge P1 is diffused as sustain discharges P2 and P3 into the second electrodes 132 and 142 disposed adjacent to the first electrodes 131 and 141 and the third electrodes 133 and 143 through the connecting electrodes 134 and 144.

Ultraviolet rays are emitted from the discharge gas by reducing the energy level of the excited discharge gas through the sustain discharges P1, P2, and P3. The ultraviolet rays excite the fluorescent layer 125 coated in the discharge cells 160, and visible light is emitted from the fluorescent layer 125 by reducing the energy level of the fluorescent layer 125, thereby forming an image by the emitted visible light.

Figure 5:
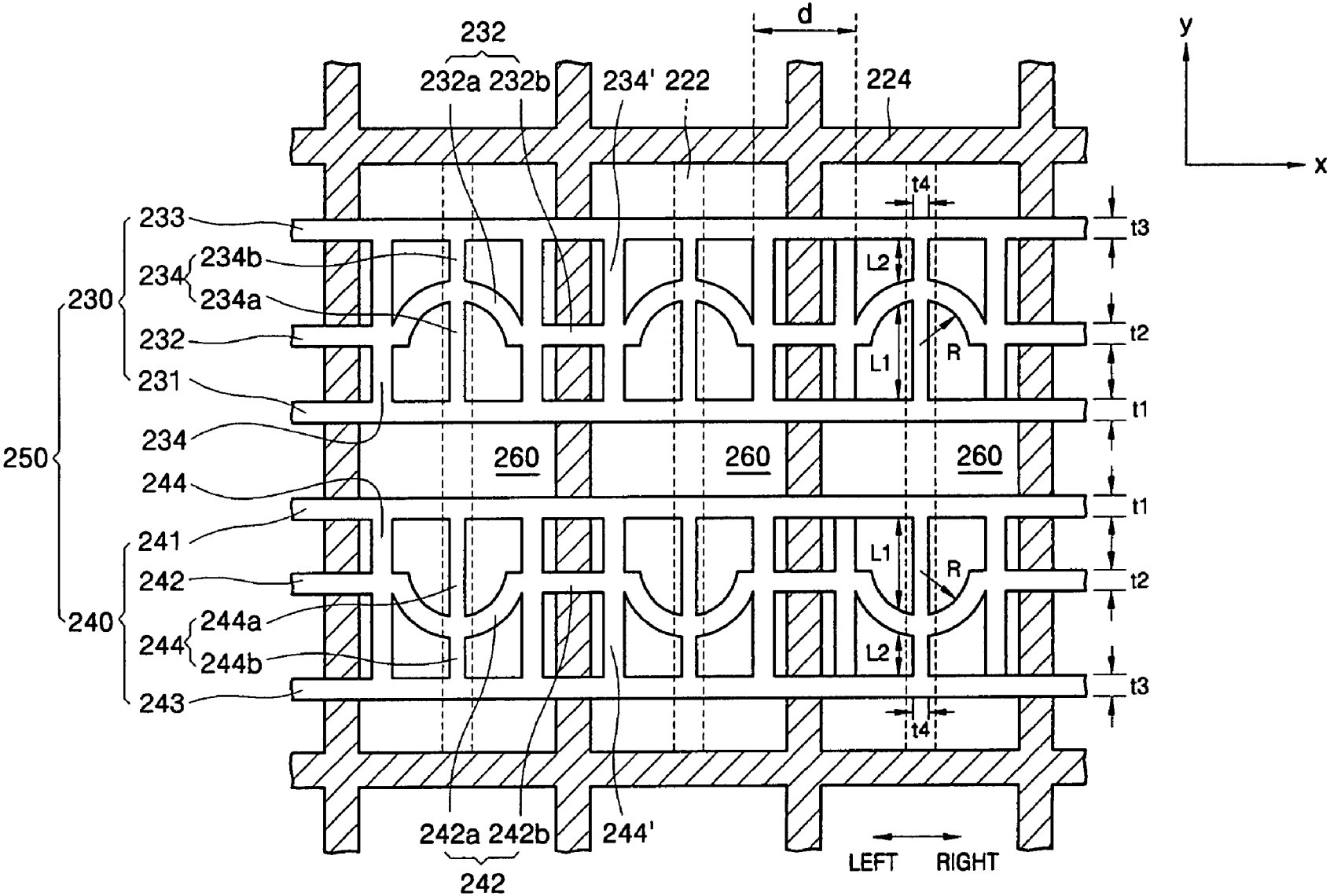
FIG. 5 is a plan view illustrating a PDP according to another embodiment of the present invention.

FIG. 5 is a plan view of an electrode structure of a PDP according to another embodiment of the present invention. Referring to FIG. 5, a discharge electrode pair 250 includes a common electrode 230 and a scanning electrode 240. The common electrode 230 and the scanning electrode 240, respectively, include first electrodes 231 and 241, second electrodes 232 and 242, and third electrodes 233 and 243 sequentially disposed from an inner side of discharge cells 260. Here, the first electrodes 231 and 241 and the third electrodes 233 and 243 are formed in, for example, a stripe shape in an x direction. The second electrodes 232 and 242 include concave parts 232*a* and 242*a* separated a predetermined distance (d) from each other along an extending direction of the second electrodes 232 and 242. Also, connecting electrodes 234 and 244 for connecting the first, second, and third electrodes 231-233 and 241-243, respectively are formed. However, in FIG. 5 unlike in FIG. 3, connecting electrodes 234' and 244' that pass through straight parts 232*b* and 242*b* on both sides of the concave parts 232*a* and 242*a* are formed on left and right sides of the connecting electrodes 234 and 244 in addition to the connecting electrodes 234 and 244 that pass through the semi-circular shape of the concave parts 232*a* and 242*a*.

More specifically, each of the second parts 234*b* and 244*b* of the connecting electrodes 234 and 244 is the shortest (shortest distance L2) distance between the second electrodes 232 and 242 and the third electrodes 233 and 243. The distance progressively increases along left and right sides of the second parts 234*b* and 244*b*. As in the FIG. 3 embodiment, a stable diffusion on the straight parts 232*b* and 242*b* is relatively difficult compared to the previous one since the second electrode (232, 242) and the third electrode (233, 243) in the straight parts 232*b* and 242*b* are far from each other. Therefore, in one embodiment of the present invention, a smooth discharge diffusion along the connecting electrodes 234' and 244' is induced by additionally forming the connecting electrodes 234' and 244' passing through the straight parts 232*b* and 242*b*.

In one embodiment, the connecting electrodes 234 and 244 including first parts 234*a* and 244*a* and second parts 234*b* and 244*b*, the barrier ribs 224, and address electrodes 222 are identical or similar to those described with reference to FIGS. 2 and 3.

Figure 6:
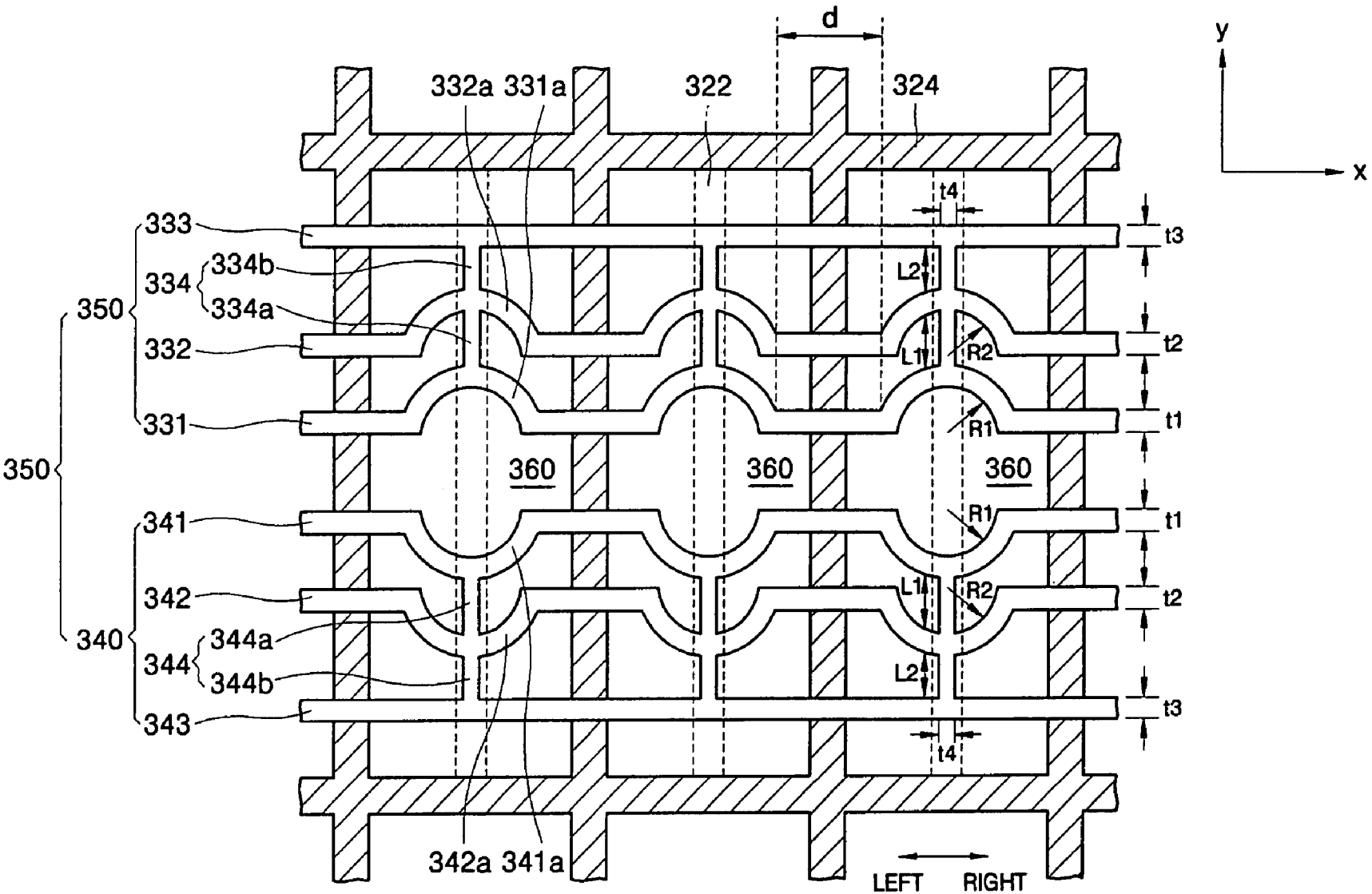
FIG. 6 is a plan view illustrating a PDP according to still another embodiment of the present invention.

FIG. 6 is a plan view of an electrode structure according to still another embodiment of the present invention. A PDP according to the present embodiment includes elements identical with the elements of the PDP described with reference to FIGS. 2 and 3 except for the elements which will be described below.

In the present embodiment, a plurality of first concave parts 331*a* and 341*a* separated a predetermined distance "d" from each other are formed along the extending direction (x direction) of first electrodes 331 and 341 unlike in FIGS. 2 and 3. The first concave parts 331*a* and 341*a* are formed in a semi-circular shape having a predetermined curvature radius R1 to surround the center of each of discharge cells 360. The first concave parts 331*a* and 341*a* facilitate the concentration of plasma generated by a discharge in the center of the discharge cells 360. That is, an electric field plane formed in a semi-circular shape along the first concave parts 331*a* and 341*a* promotes the generation of plasma and prevents the plasma from disappearing by colliding with barrier ribs 324 through concentrating the plasma in the center of the discharge cells 360.

Particularly, as shown in FIG. 6, second concave parts 332*a* and 342*a* can be formed in the second electrodes 232 and 242 together with the first concave parts 331*a* and 341*a* of the first electrodes 231 and 241. In this case, a further effective plasma concentration in the center of the discharge cells 360 is obtained by overlapping an electric field plane formed by the first concave parts 331*a* and 341*a* and an electric field plane formed by the second concave parts 332*a* and 342*a*. In one embodiment, the second concave parts 332*a* and 342*a* may be formed in substantially identical shapes to the first concave parts 331*a* and 341*a*. For example, as depicted in FIG. 6, if the first concave parts 331*a* and 341*a* and the second concave parts 332*a* and 342*a* are formed in semi-circular shapes, the first concave parts 331*a* and 341*a* and the second concave parts 332*a* and 342*a* may have an identical curvature radius (in FIG. 6, R1=R2).

The distance between the first electrodes 331 and 341 and second electrodes 332 and 342 is substantially maintained uniform along the extending direction of the first electrodes 331 and 341 and second electrodes 332 and 342. This is because the first concave parts 331*a* and 341*a* are formed along the first electrodes 231 and 241. In this way, the discharge diffusion is promoted between the first electrodes 231 and 241 and the second electrodes 232 and 242. The stable discharge diffusion, from the second electrodes 232 and 242 into the third electrodes 233 and 243 through the second concave parts 332*a* and 342*a*, can be achieved in the same manner as described with reference to FIGS. 2 and 3.

Other elements, such as a discharge electrode pair 350 that include a common electrode 330 and a scanning electrode 340, connecting electrodes 334 and 344 that include first parts 334*a* and 344*a* and second parts 334*b* and 344*b*, address electrodes 322, and barrier ribs 324, are substantially identical to those described with reference to FIGS. 2 and 3.

The PDP according to embodiments of the present invention has the following advantages.

First, since the discharge electrode pairs of the PDP are formed of metal electrodes without transparent electrodes, an expensive patterning for forming transparent electrodes is not required, and aligning between electrodes is unnecessary. Thus, a manufacturing process is simplified, work efficiency is improved, and manufacturing costs are reduced.

Second, the PDP according to one embodiment of the present invention includes discharge electrode pairs on which a plurality of concave parts are formed along the extending direction of the electrodes. Through the concave parts, an initial discharge can be diffused into the entire region of the discharge cells, plasma can be concentrated in the center of the discharge cells to display a high brightness image, and light emission efficiency can be improved.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A plasma display panel, comprising:

an upper substrate and a lower substrate facing each other;

a plurality of barrier ribs disposed between the upper substrate and the lower substrate to define a plurality of discharge cells together with the upper substrate and the lower substrate;

at least one pair of discharge electrodes that generate a discharge and extend across the discharge cells consecutively disposed in one direction;

a plurality of address electrodes consecutively disposed to cross the discharge electrodes;

an upper dielectric layer and a lower dielectric layer, respectively, covering the at least one pair of discharge electrodes and the plurality of address electrodes;

a fluorescent layer disposed in the discharge cells;

a discharge gas filled in the discharge cells, wherein each discharge electrode includes first, second and third electrodes which have substantially the same length, wherein the first electrode is closer to the center area of a respective discharge cell than the third electrode, wherein the second electrode is located between the first and third electrodes, and wherein the second electrode comprises a plurality of first substantially semi-circular concave portions each of which is formed in a direction generally facing the center area of the respective discharge cell; and a plurality of connecting electrodes each connecting electrode formed across the discharge cells and extending from the first electrode to the third electrode through generally the center area of each respective concave portion.

2. The plasma display panel of claim 1, wherein the first electrode comprises a plurality of second substantially semi-circular concave portions each of which is formed in a direction generally facing the center area of the respective discharge cell.

3. A plasma display panel, comprising:

an upper substrate and a lower substrate facing each other;

a plurality of barrier ribs disposed between the upper substrate and the lower substrate to define a plurality of discharge cells together with the upper substrate and the lower substrate; and a plurality of discharge electrode pairs extended across the discharge cells consecutively disposed in one direction, wherein each of the discharge electrodes that constitute a respective discharge electrode pair comprises:

a first electrode and a third electrode separated from each other and extended parallel to each other in one direction;

a second electrode, located between the first and third electrode, including a plurality of first substantially semi-circular concave portions each of which is formed in a direction generally facing the center area, in a plane which is substantially parallel to the substrates, of a respective discharge cell, wherein the first, second and third electrodes have substantially the same length; and a plurality of first connecting electrodes each connecting electrode formed across the discharge cells and extending from the first electrode to the third electrode through generally the center area of each respective concave portion.

4. The plasma display panel of claim 3, wherein the first electrode, the second electrode, and the third electrode are formed of a metal.

5. The plasma display panel of claim 3, wherein each of the plurality of semi-circular concave portions is located within each respective discharge cell in a plane which is substantially parallel to the substrates.

6. The plasma display panel of claim 3, wherein the first electrode is disposed on the innermost side of the discharge cells, and wherein the first electrode includes a plurality of second substantially semi-circular concave portions each of which is formed in a direction generally facing the center area, in a plane which is substantially parallel to the substrates, of a respective discharge cell.

7. The plasma display panel of claim 6, wherein at least one of the first concave portions has a substantially identical curvature radius to at least one of the second concave portions.

8. The plasma display panel of claim 3, further comprising a plurality of second connecting electrodes formed on both ends of each concave portion and configured to connect the first, second and third electrodes.

9. The plasma display panel of claim 8, wherein at least one of the discharge cells is associated with i) one of the first connecting electrodes and ii) two of the second connecting electrodes, wherein the one first connecting electrode and the two second connecting electrodes are substantially parallel to each other, and wherein the one connecting electrode and the two connecting electrodes are located within a respective discharge cell in a plane which is substantially parallel to the substrates.

10. A plasma display panel, comprising:

a plurality of discharge cells located between first and second panels opposing each other; and at least one pair of discharge electrodes configured to generate a discharge and extending across the discharge cells, wherein each discharge electrode comprises first, second and third electrodes which have substantially the same length, wherein the first electrode is closer to the center area of a respective discharge cell than the third electrode, wherein the second electrode is located between the first and third electrodes, and wherein the second electrode comprises a plurality of first substantially semi-circular concave portions each of which is formed in a direction generally facing the center area of the respective discharge cell; and a plurality of first connecting electrodes each connecting electrode formed across the discharge cells and extending from the first electrode to the third electrode through generally the center area of each respective concave portion.

11. The plasma display panel of claim 10, wherein the first electrode comprises a plurality of second substantially semi-circular concave portions each of which is formed in a direction generally facing the center area of the respective discharge cell.

12. The plasma display panel of claim 11, further comprising a plurality of second connecting electrodes formed on both ends of each concave portion and configured to connect the first, second and third electrodes.

13. An electrode structure for a plasma display panel, the structure comprising:

at least one pair of discharge electrodes configured to generate a discharge and extending across a plurality of discharge cells, wherein each discharge electrode comprises first, second and third electrodes which have substantially the same length, wherein the first electrode is closer to the center area of a respective discharge cell than the third electrode, wherein the second electrode is located between the first and third electrodes, and wherein the second electrode comprises a plurality of first substantially semi-circular concave portions each of which is formed in a direction generally facing the center area of the respective discharge cell; and a plurality of first connecting electrodes each connecting electrode formed across the discharge cells and extending from the first electrode to the third electrode through generally the center area of each respective concave portion.

14. The plasma display panel of claim 13, wherein the first electrode comprises a plurality of second substantially semi-circular concave portions each of which is formed in a direction generally facing the center area of the respective discharge cell.

15. The plasma display panel of claim 14, further comprising a plurality of second connecting electrodes formed on both ends of each concave portion and configured to connect the first, second and third electrodes.

16. The plasma display panel of claim 13, wherein each of the plurality of semi-circular concave portions is located within each respective discharge cell in a plane which is substantially parallel to the panels.

* * * * *

UNITED STATES PATENT AND TRADEMARK OFFICE

CERTIFICATE OF CORRECTION

PATENT NO. : 7,504,777 B2
APPLICATION NO. : 11/190627
DATED : March 17, 2009
INVENTOR(S) : Tae-Kyoung Kang It is certified that error appears in the above-identified patent and that said Letters Patent is hereby corrected as shown below:

| Column | Line | |
|---|---|---|
| Page 1 (Item 54) | 1-3 | Change "PLASMA DISPLAY PANEL WITH SEMI-CIRCULAR DISCHARGE ELECTRODE STRUCTURE" to --PLASMA DISPLAY PANEL--. |
| 1 (Title) | 1-3 | Change "PLASMA DISPLAY PANEL WITH SEMI-CIRCULAR DISCHARGE ELECTRODE STRUCTURE" to --PLASMA DISPLAY PANEL--. |

Signed and Sealed this

Twentieth Day of October, 2009

David J. Kappos

David J. Kappos
*Director of the United States Patent and Trademark Office*